United States Patent [19]

Seigel

[11] 4,087,238

[45] May 2, 1978

[54] METHOD FOR ENHANCING THE HEATING EFFICIENCY OF CONTINUOUS SLAB REHEATING FURNACES

[75] Inventor: Lawrence G. Seigel, Franklin Township, Westmoreland County, Pa.

[73] Assignee: United States Steel Corporation, Pittsburgh, Pa.

[21] Appl. No.: 722,835

[22] Filed: Sep. 13, 1976

[51] Int. Cl.[2] ..... F27B 9/12

[52] U.S. Cl. ..... 432/18; 432/49

[58] Field of Search ..... 432/11, 18, 45, 49; 266/251

[56] References Cited

U.S. PATENT DOCUMENTS

| | | | |
|---|---|---|---|
| 2,927,783 | 3/1960 | Bloom et al. | 432/18 |
| 3,373,980 | 3/1968 | Borgkrist | 432/11 |
| 3,604,695 | 9/1971 | Steeper | 432/11 |
| 3,695,594 | 10/1972 | Hollander | 432/11 |

*Primary Examiner*—John J. Camby

*Attorney, Agent, or Firm*—Arthur J. Greif

[57] ABSTRACT

Significant energy savings are achieved in the operation of reheat furnaces when the preheat zone temperatures are maintained as low as possible consistent with the demands of the hot strip mill. While the benefits of this invention may be realized through manual adjustment, further energy savings are achieved through the utilization of automatic controls and proper scheduling in which slabs of approximately the same thickness are placed into groupings so that a first grouping of tandum slabs enters the furnace, followed by a second grouping of different thickness.

7 Claims, 3 Drawing Figures

METHOD FOR ENHANCING THE HEATING EFFICIENCY OF CONTINUOUS SLAB REHEATING FURNACES

The instant invention relates to the control of continuous reheat furnaces and more particularly to the achievement of energy conservation for the types of furnaces used to reheat slabs immediately prior to processing in hot rolling mills.

The term slabs will be used throughout the following description as a generic expression to include blooms, billets, etc. Metal slabs utilized for hot rolling to semi-finished products are conventionally stored for extended periods of time, until required for processing by the hot rolling mill. As a result of such storage, the slabs are cooled to various extents. Generally, the slabs cool down in a slab yard to a temperature approaching that of ambient air. In all such cases the slab must be reheated before further processing in the roll mill, generally to temperatures of about 1150° to 1320° C. Slab reheating furnaces generally are of a continuous design, with cool slabs entering into a preheat zone, followed by a heat zone and then finally through a soak zone in which the temperature of the center of the slab is permitted to equalize to that at the surface of the slab. In some furnaces, the heat and soak functions are accomplished in one zone. The furnaces are categorized by the method of propelling the slabs through the furnace and by the placements of the various fuel or gas burners. Two major categories of slab propulsion are employed: (i) a pusher-type furnace or (ii) a walking beam-type furnace in which the slabs are walked toward the discharge end by movable supports. The various categories of burner placements are shown in *The Making, Shaping and Treating of Steel,* 9th Edition, page 668. Additionally, the burners may be so situated as to achieve either (a) counter-flow heat exchange in which the hot gases always flow counter to direction of slab movement, or (b) the recent development for reverse firing of furnaces, such as shown in the paper "Trends in Slab Reheating Furnace Requirements and Design, W. R. Laws, Proc. ISI Conf. on Slab Reheating, Bournemouth, June 1972, ISI Publication 150, pages 1–10, London 1973". The instant invention is concerned primarily with the type (a) counter-flow continuous-type furnaces.

The function of any slab reheating furnace control system is to effect the heating of a slab to a particular temperature, appropriate to the rolling schedule designed for that slab. Since varying heat inputs may be required, depending on the mass of the slab and on the temperature to which it is to be raised, optimal control often is very difficult to achieve. Additionally, mill delays often result in many slabs being held within the furnace for indeterminate periods, longer than would be regarded as optimum. As a result of this difficulty in achieving accurate temperature control, significant amounts of energy are wasted. A variety of automatic control systems have therefore been devised to more accurately achieved temperature control. Exemplary of these automatic control systems is the method shown in U.S. Pat. No. 3,695,594. Although some improvement in energy utilization has been achieved as a result of such computerized temperature control systems, the thrust thereof has primarily been directed to the achievement of temperature control.

In studies primarily directed to learning how furnace operating practice may be changed to obtain minimum fuel consumption, it was determined that best furnace economy results when the preheat zone is maintained at the lowest possible temperature consistent with the achievement of a desired exit slab temperature. Further economies will also result if the heat zone temperature is maintained as low as possible, consistent with the achievement of desired exit slab temperature. However, it will generally not be possible to operate with low heat zone temperatures (i.e. temperatures significantly below that of the desired slab exit temperature) when utilizing high throughputs.

It is therefore a principle object of this invention to provide a method for achieving significant economies in furnace operation.

It is a further object of this invention to provide a system of furnace control which is compatible with a variety of computer control systems for achieving accurate temperature control.

These and other objects of the invention will become more readily apparent from a reading of the following description when read in conjunction with the appended claims and the drawings in which:

It is readily apparent that it would be possible to select a variety of combinations of zone temperature settings to obtain a specifically desired slab temperature, but only one properly chosen combination of settings will result in required furnace capacity, combined with minimum fuel consumption. Stated another way, a variety of furnace temperature profiles may be utilized in achieving a final desired exit temperature. Conventional temperature profiles are illustrated in U.S. Pat. No. 3,868,094 and in the above-noted article by Laws.

Figure 1:
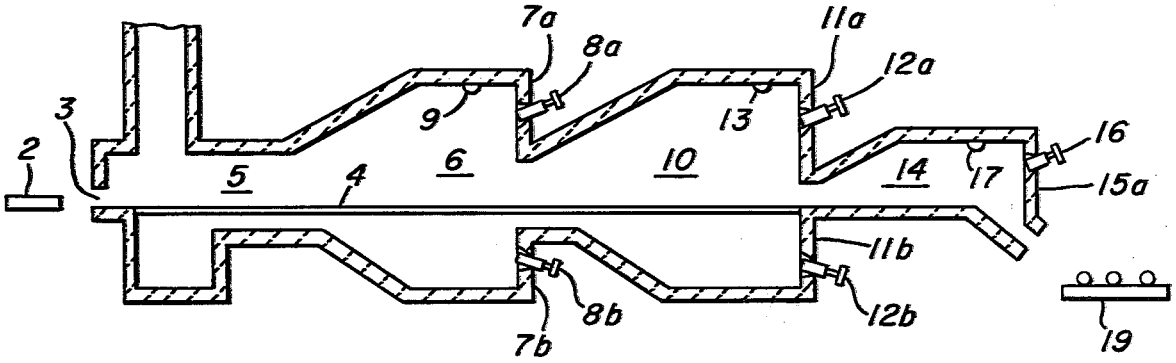
FIG. 1 is a representational illustration of a 5-zone slab reheat furnace.

The operation of a continuous, counter-current slab reheating furnace and the achievement of such temperature profiles will better be understood by reference to FIG. 1. While this figure is illustrative of a 5-zone type furnace it will be readily apparent that the method of this invention is similarly applicable to other counter-flow, continuous-type furnaces, e.g. 3-zone or 4-zone reheat furnaces. A slab 2, taken from the storage facility, is charged into the reheat furnace through a charging door 3. The slab moves along a skid 4 through a throat 5 and into the preheat zone or chamber 6. This preheat chamber includes an upper firing wall **7*a* and a lower firing wall 7*b* into which are mounted burners 8*a* and 8*b* respectively. Although not illustrated here, there is generally a row of such burners extending across the width of the furnace, for maintaining a substantially uniform temperature gradient through the cross-section thereof. The gas temperature in the preheat zone, commonly referred to as the roof temperature, is measured by preheat thermocouple 9 suitably mounted near the roof. Heat zone 10 is constructed in a similar manner, in that it includes an upper firing wall 11*a* and a lower firing wall 11*b*, into which are mounted a row of burners represented by 12*a* and 12*b* respectively. The temperature of this zone is similarly measured by a roof mounted thermocouple 13. The slab passes from the heat zone into soak zone 14 which is used to equalize temperatures from the surface to the center of the slab. This zone, however, has a single firing wall 15*a* with a row of burners represented by 16, located above the pass line for the slabs. Here again, thermocouple 17 measures the gas or roof temperatures within this zone. The reheated slab is discharged from the furnace through door 18 onto roller tables 19**, for transport to further processing in the rolling mill. It should be understood that the temperature profile within any of the zones is not constant; and increases in a generally linear manner from a minimum temperature at the entrance to each chamber, to a plateau within the chamber, before falling to a minimum at the entry to the next zone. Therefore, for purposes of this invention, it should be understood, in referring to the temperature of a particular zone, that such temperature will be with reference to the maximum temperature (i.e. the plateau temperature) of that zone.

Figure 2:
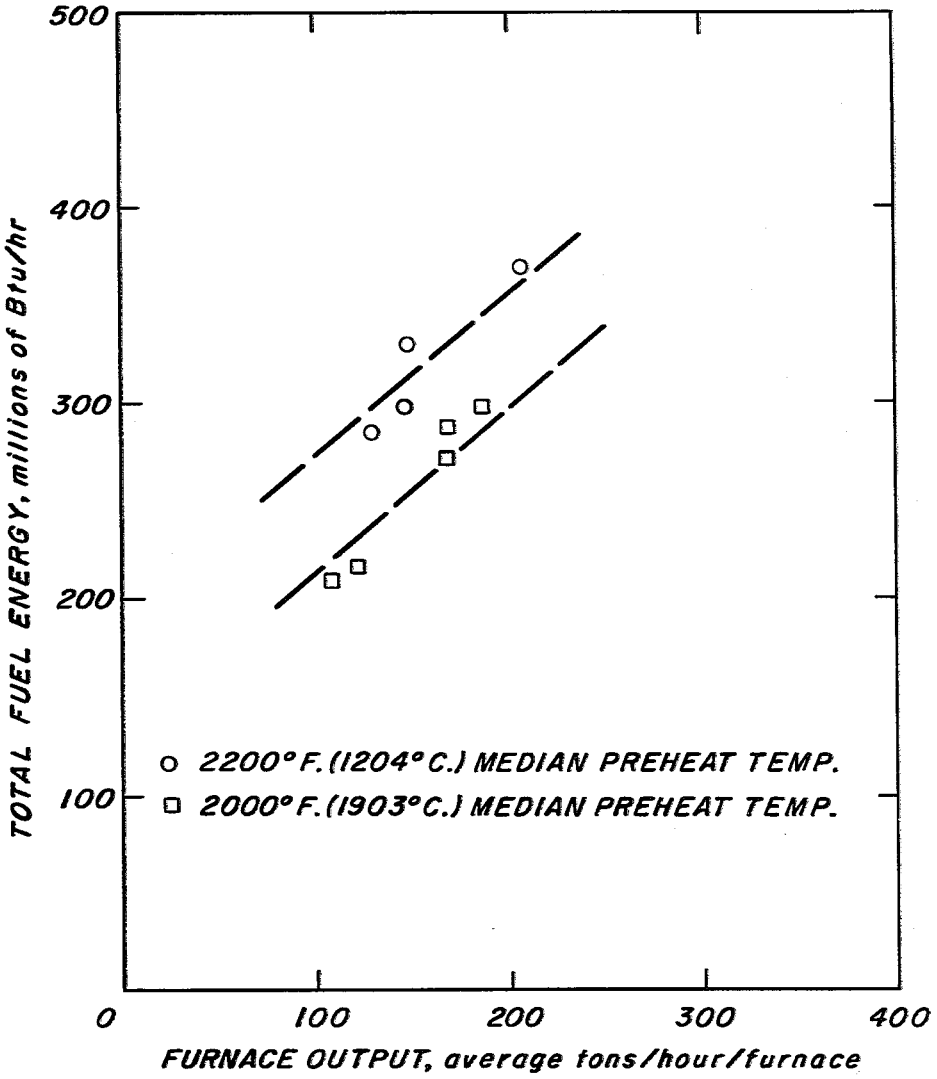
FIG. 2 is a graph illustrating the energy requirements of preheat furnaces as a function of preheat temperature.

As a result of initial studies which indicated a trend toward reduced fuel consumption at lower than normal preheat temperatures, a test program was run for nine turns. In this test program the median soak zone temperature was 2350° F (1287° C) for all nine turns; four turns were operated at an average temperature of 2200° F (1204° C) preheat and five turns were operated at an average of 2000° F (1093° C) preheat. The energy consumption for the furnace, obtained during this test period, is shown in FIG. 2. These results clearly show the advantage of furnace operation at lower than normal preheat temperature. For example, utilizing an average slab heating rate of 150 tons per hour per furnace, a 19% energy advantage was achieved when the preheat temperature was 2000° F (1093° C) as compared with that utilizing the preheat temperature of 2200° F (1204° C). For lower furnace outputs it may readily be seen that even greater percentages of savings will be achieved (since the total fuel energy consumed at 2200° F, i.e. the numerator, will be smaller).

To further substantiate these projected energy savings, furnace operation at low preheat temperatures, in accord with this invention, was measured over a 9-week period for four different furnaces. These data, are summarized in Table I below.

Table I

Energy Consumption for Reheat Furnaces on 84-Inch (2.13 m) Hot Strip Mill

| Date (1975) | | Energy Consumption, Millions of Btu/ton | | | |
|---|---|---|---|---|---|
| | | Furnace No. 1 | Furnace No. 2 | Furnace No. 3 | Furnace No. 4 |
| 9/2 - 9/6 | | 2.262 | 2.551 | 2.147 | 3.057 |
| 9/9 - 9/13 | | 2.265 | 2.564 | 1.961 | 3.282 |
| | Average | 2.263 | 2.557 | 2.054 | 3.169 |
| 9/16 - 9/20 | | 1.983 | 2.277 | 1.751 | 2.617 |
| 9/23 - 9/27 | | 2.098 | 2.373 | 1.643 | 2.456 |
| 10/1 - 10/5 | | 2.010 | — | 1.564 | 2.025 |
| 10/9 - 10/13 | | 2.066 | 2.170 | 1.670 | 1.918 |
| 10/16 - 10/20 | | 2.012 | 2.126 | 1.574 | — |
| *10/23 - 10/29 | | 2.084 | 2.367 | 1.637 | — |
| 10/31 - 11/4 | | 2.000 | 2.108 | 1.601 | — |
| | Average | 2.036 | 2.237 | 1.634 | 2.254 |
| Percent Saving Due to Low Preheat | | 10.0 | 12.5 | 20.4 | 28.9 |

NOTES:
1. Calculated on basis of 1000 Btu per $ft^3$ (37.258 $MJ/m^3$) of natural gas and 500 Btu per $ft^3$ (18.63 $MJ/m^3$) of coke-oven gas.
2. Tonnage based on product tons, not furnace tons of steel heated.

The data include the total tons heated and the total gas used for the number of operating turns during each week. The September 2 and September 9 test periods, reflect energy usage typical of past operating practice, i.e. prior to utilization of the instant invention. The remaining test periods reflect the operator's efforts, by manual control, to maintain preheat temperatures at a value at least 10% below that existing in the soak zone. The average performance of each furnace before the test period and after the test period is summarized. Utilizing manual control, which ordinarily will vary from operator to operator, it is nevertheless seen that fuel savings of from 10 to 28.9% were achieved during the evaluation period.

These differences in energy utilization resulted, to some extent, from the variation in throughput (see FIG. 2) of the four furnaces. However, it was found that to a greater extent, the differences were dependent on the ability of a particular operator to achieve the lowest practicable preheat temperatures. Thus, significant energy savings will be realized by utilizing a target preheat temperature, $T_p$, which is at least 10% below that of the median temperature (where median temperature is the temperature line that divides the time-temperature curve into equal areas and where $T_p$ and the median temperature are measured in degrees Centigrade) of the soak zone. It is even more desirable, however, that $T_p$, in ° C, be no greater than 85% (at least 15% below) that of the soak zone median temperature, in ° C. Preferably, $T_p$ will be maintained as low as possible consistent with the achievement of a desired exit slab temperature. It is also desirable that both the preheat and soak zone temperatures be maintained nearly as constant as possible. Naturally, this will not always be possible. However, with respect to the preheat zone it is desirable, over an extended period of time, that the actual preheat temperatures not exceed $T_p + 50°$ C for more than about 20% of the total operating time.

To better understand the significance of the above-noted savings, even utilizing a conservative estimate of a ten percent fuel saving; at present day costs for natural gas about $220,000 would be saved for every million tons of throughput. It bears further emphasis, however, that a 10% fuel saving is a very conservative estimate, dependent on the unpredictability of operator performance. It is therefore preferable to eliminate variances in operator performances, through the use of an automatic control system.

Figure 3:
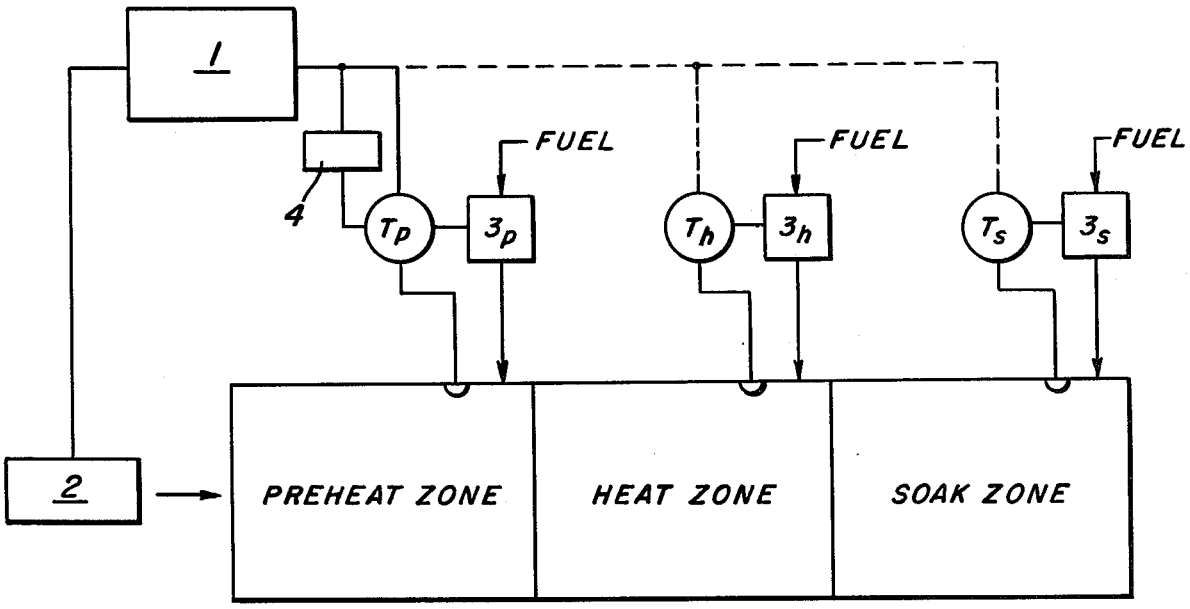
FIG. 3 is a block diagram of an automatic control system for maintaining low preheat temperatures.

FIG. 3 is a block diagram of a control system which may be utilized to automatically achieve control in accord with the principles of this invention. Referring to that figure, computer 1 calculates the available heating time from data on slab thickness, slab width, slab material characteristics, mill speed, etc., for all slabs in the furance at the time slab 2 enters the furnace. Utilizing data stored in its memory, the computer regulates burner 3*p* to set a preheat temperature $T_p$ approximately to the lowest value required to heat slab 2 to the desired exit temperature, in the allowable time just calculated. The computer also sets timer 4 for a period of time equal to the time allowable. A similar calculation is made for each slab entering the furnace, but $T_p$ is not changed unless a thicker slab requires a higher temperature or unless the time set by timer 4 has expired. If a higher value of $T_p$ is indicated, it is set along with the new value for timer 4. If timer 4 has expired, the next lower value for $T_p$ for any slab still in the preheat zone or heat zone of the furnace is set with its remaining time and this condition will remain until timer 4 again expires or a thicker slab enters the furnace. Temperatures $T_h$ and $T_s$ may be maintained constant during operation of the furnace, or $T_h$ may be lowered, e.g. during extended delay periods.

The full benefits of this invention will better be realized if the slabs entering the furnace are scheduled so that the thicknesses of consecutive slabs do not vary to a great extent, i.e. thick-thin, thick-thin, etc. Thus, it is desirable that for at least a major portion of the total operating time the variation in thickness of at least 10 successive slabs is not greater than 20% of the average thickness of said 10-slab grouping. It is further desirable that such scheduling be maintained for at least about 90% of the operating time, and it is considered even more preferable that such groupings contain at least 20 consecutive slabs, not varying in thickness by more than 20% of the average thickness of the 20-slab grouping.

I claim:

1. In the reheating of slabs to temperatures of about 1150° to 1320° C for further processing in a roll mill, wherein said slabs are elevated to such temperatures by passage through a continuous, co-current fired, pusher type, slab reheating furnace, comprising a preheat zone, a heat zone and a soak zone and heating means associated with each such zone, in which the soak zone is maintained at a median temperature approximately that of a desired exit slab temperature, and the heat zone is maintained at a temperature below that at which the surface of the slabs would melt to a significant extent, but at least that required to impart sufficient heat to achieve said desired exit slab temperature, and wherein the slabs on exiting said furnace are thereafter hot-rolled to semi-finished products, the improvement for enhancing the heating efficiency of said furnace which comprises, (a) maintaining said preheat zone at a median temperature, $T_p$, (i) at least that required to provide a heat-rate sufficient to achieve said desired exit slab temperature, but (ii) no greater than 90% of said soak zone median temperature, $T_s$; wherein $T_p$ and $T_s$ are measured in ° C.

2. The method of claim 1, wherein the actual preheat temperature does not exceed $T_p + 50°$ C for a period of time more than about 20% of the total operating time.

3. The method of claim 2, wherein $T_p$ is no greater than 85% of said soak zone median temperature, $T_s$.

4. The method of claim 1, including the steps of (b) determining the maximum permissible residence time, $r_1$, for a slab in its passage through the furnace, (c) determining a preheat temperature, $T_{p1}$, associated with said slab, wherein $T_{p1}$, falls within the constraints of step (a), (d) adjusting the output of the preheat zone heating means to extablish $T_{p1}$, as the temperature of the preheat zone, (e) determining the maximum residence times, $r_2$, $r_3$ . . . for each subsequent slab in its passage through the furnace, (f) utilizing the constraints of step (a), determining $T_{p2}$, $T_{p3}$ . . . , the respective preheat temperatures for each such subsequent slab, (g) adjusting the output of said heating means to establish a higher preheat temperature when a subsequent $T_p$ value for a slab in the preheat zone is higher than that established in step (d), and (h) adjusting the output of said heating means to establish a preheat temperature next lowest to $T_{p1}$, when (i) time interval $r_1$ has expired and (ii) when no higher $T_p$ value is indicated by step (g).

5. The method of claim 4, wherein the slabs entering the furnace are scheduled so that for a major portion of the total operating time, the variation in thickness for a grouping of at least 10 successive slabs is not greater than 20% of the average thickness of said 10-slab grouping.

6. The method of claim 5, wherein said major portion is greater than about 90% of the total operating time.

7. The method of claim 5, wherein said scheduling is such that at least 20 successive slabs do not vary in thickness by more than 20% of the average thickness of said 20-slab grouping.

* * * * *